US006809711B2

(12) United States Patent
Funston

(10) Patent No.: US 6,809,711 B2
(45) Date of Patent: Oct. 26, 2004

(54) DISPLAY DRIVER AND METHOD FOR DRIVING AN EMISSIVE VIDEO DISPLAY

(75) Inventor: David L. Funston, Batavia, NY (US)

(73) Assignee: Eastman Kodak Company, Rochester, NY (US)

( * ) Notice: Subject to any disclaimer, the term of this patent is extended or adjusted under 35 U.S.C. 154(b) by 245 days.

(21) Appl. No.: 09/848,067

(22) Filed: May 3, 2001

(65) Prior Publication Data

US 2002/0186187 A1 Dec. 12, 2002

(51) Int. Cl.[7] ..... G09G 3/32; G09G 3/30; G09G 5/00

(52) U.S. Cl. ..... 345/82; 345/76; 345/204

(58) Field of Search ..... 345/76, 82, 98, 345/99, 100, 204, 211, 212, 213, 214, 581, 667, 698, 699, 55; 713/324

(56) References Cited

U.S. PATENT DOCUMENTS 4,823,121 A 4/1989 Sakamoto et al.
4,859,910 A 8/1989 Iwakawa et al.
5,345,250 A * 9/1994 Inoue et al. ..... 345/100
5,389,952 A 2/1995 Kikinis
5,532,719 A 7/1996 Kikinis
5,565,897 A 10/1996 Kikinis et al.
5,648,799 A 7/1997 Kikinis
5,757,139 A 5/1998 Forrest et al.
5,805,121 A * 9/1998 Burgan et al. ..... 345/103
5,867,140 A * 2/1999 Rader ..... 345/98
5,952,789 A 9/1999 Stewart et al.
5,977,704 A 11/1999 Shi et al.
6,008,588 A 12/1999 Fujii
6,023,259 A 2/2000 Howard et al.
6,181,313 B1 * 1/2001 Yokota et al. ..... 345/100
6,529,178 B1 * 3/2003 Kimura ..... 345/76
2002/0186214 A1 * 12/2002 Siwinski ..... 345/212
2003/0080967 A1 * 5/2003 Milch et al. ..... 345/589
2003/0222866 A1 * 12/2003 Funston et al. ..... 345/211

* cited by examiner

*Primary Examiner*—Chanh Nguyen
*Assistant Examiner*—Paul A. Bell
(74) *Attorney, Agent, or Firm*—Roland R. Schindler, II

(57) ABSTRACT

According to a feature of the present invention, a method is provided for using a two-dimensional matrix of light emitting elements to display an image electronically encoded in the form of illumination values. An array of elements including less than all of the elements in the matrix to display the image is defined. A sweep rate for writing the illumination values for the elements in the array is determined, and a sweep signal having the illumination values for the elements in the array is generated, where the sweep signal writes illumination values for the elements in the array at the determined sweep rate. According to another embodiment of the present invention, a display driver generates an image encoded in the form of illumination values. The driver includes an image source and a controller receiving the image from the image source, said controller being adapted to (1) define an array of elements including fewer than all of the elements in the matrix for display of the image (2) determine a sweep rate for writing illumination values to the array of elements, and (3) generate images by writing illumination values to the elements in the array at the sweep rate.

19 Claims, 7 Drawing Sheets

DISPLAY DRIVER AND METHOD FOR DRIVING AN EMISSIVE VIDEO DISPLAY

FIELD OF THE INVENTION

The present invention relates to a display driver and method for operating an emissive light video display.

BACKGROUND OF THE INVENTION

Status displays are an important feature of electronic devices such as cellular telephones, global positioning systems (GPS), CD players, video cameras, digital cameras, conventional cameras, hybrid cameras and other devices. Status displays are used to inform the user of such a device about conditions that may impact the operation of the device. Examples of status displays include displays that indicate cellular telephone signal strength, battery status, and other warnings. These displays are typically active whenever the device is active. Because these displays are often in use, it is necessary that these displays consume little power.

In the prior art, it is known to use Light Emitting Diodes, LEDs, and Liquid Crystal Displays, LCDs to present status information to the user of a hand held electronic device. These LEDs and LCDs are typically arranged or shaped in the form of icons that symbolically represent the status of the device. Using such displays, the status of the device can readily be ascertained by observing whether the LEDs or LCDs are active. Such LEDs and LCDs draw little power and are simple to operate. However, it will be appreciated that at least one separate LED or LCD must be incorporated into the portable electronic device for each status display. This increases the size and weight of the portable device, typically reducing the convenience and portability of the device.

In the prior art, it is also known to provide video displays in hand held and portable devices. Such video displays are typically formed from a two dimensional matrix of image forming elements. In a preferred form of video display known as the Emissive Light Display, ELD, the image forming elements comprise discrete light emitting elements. An image to be displayed using an ELD is electronically captured and encoded into illumination values. The illumination values are written to the elements of the display and the elements illuminate at an intensity level that is called for in the illumination values. Variations in the intensity of light emitted by the elements create a contrast pattern that forms the image on the display.

It will be appreciated that video displays can convey images including icons, graphics, text, still and motion images. This enables portable devices to communicate with users in a very effective fashion. Accordingly, video displays are increasingly being incorporated into portable electronic devices.

However, the video displays of the prior art have consumed too much power to permit such video displays to be operated continuously. A certain portion of the power consumed is used to cause the elements of the display to emit light. Traditionally, it has taken substantial amounts of power to cause the elements of ELDs to emit light. However, with the advent of the Organic Light Emissive Display (OLED) it has become possible to substantially reduce the amount of power consumed in causing the elements of the display to emit light.

The remaining portion of the power consumed in the operation of a video display is used by the electronic controls that control the elements of the display. These controls are collectively known as a display driver. The prior art has not provided a display driver or method for operating an OLED that is efficient enough to permit the near continuous operation of the OLED for the purposes of sustaining status displays.

In the absence of such a display driver, it has become common for portable electronic devices that incorporate video displays to also incorporate separate LED and LCD displays to present status information. It will be appreciated that incorporating such a dual display scheme into a portable electronic devices increases the number of components of the device, the cost of designing the device, and the size and weight of the device. These factors increase the cost of portable electronic devices that incorporate both video and separate LED or LCD status displays.

U.S. Pat. No. 5,977,704 recognizes that a need exists for a single display to present both video and status information. To meet this need, the '704 patent shows a single Organic Light Emissive Display (OLED) having both a video display region and an icon region. The main limitation of this solution is that it is expensive to design and manufacture such an OLED. For example, any modification to the form, number, or arrangement of icons requires a modification to the physical structure of the display device. Accordingly, a display device designed for one product in accordance with the '704 patent will not be readily adaptable for use in a second product.

Thus, what is needed is a display driver and method for displaying both icons and video images and that does not require the use of custom combination displays.

U.S. Pat. No. 4,823,121 represents one effort to reduce the power consumed in generating an image using a light emissive display. The '121 patent teaches a display control circuit for producing illumination values for controlling the illumination intensity level of light emissive display elements in an Electro-Luminescent (E-L) display panel. The '121 patent teaches that each of the illumination values associated with a horizontal row of elements in an E-L display is to be written to a shift register and examined while in the shift register. If no element in the row is to be illuminated, the driver can omit the step of transmitting the illumination values to the elements in the row and the step of applying a maintenance charge to the row of elements. The '121 patent, however, still requires that the display driver generates illumination values for all of the elements in the display, to examine the illumination values for each row to determine whether to write illumination values to each of the elements 14 in the display and to determine whether to apply a maintenance charge to the row of elements.

Thus, the forgoing needs are not met by the prior art.

SUMMARY OF THE INVENTION

According to a feature of the present invention, a method is provided for using a two-dimensional matrix of light emitting elements to display an image electronically encoded in the form of illumination values. An array of elements including less than all of the elements in the matrix to display the image is defined. A pixel rate for writing the illumination values for the elements in the array is determined, and a sweep signal having the illumination values for the elements in the array is generated, where the sweep signal writes illumination values for the elements in the array at the determined pixel rate.

According to another embodiment of the present invention, a display driver generates an image encoded in the form of illumination values. The driver includes an image source and a controller receiving the image from the image source, said controller being adapted to (1) define an array of elements including fewer than all of the elements in the matrix for display of the image (2) determine a pixel rate for writing illumination values to the array of elements, and (3) generate images by writing illumination values to the elements in the array at the pixel rate.

DETAILED DESCRIPTION OF THE INVENTION

Figure 1:
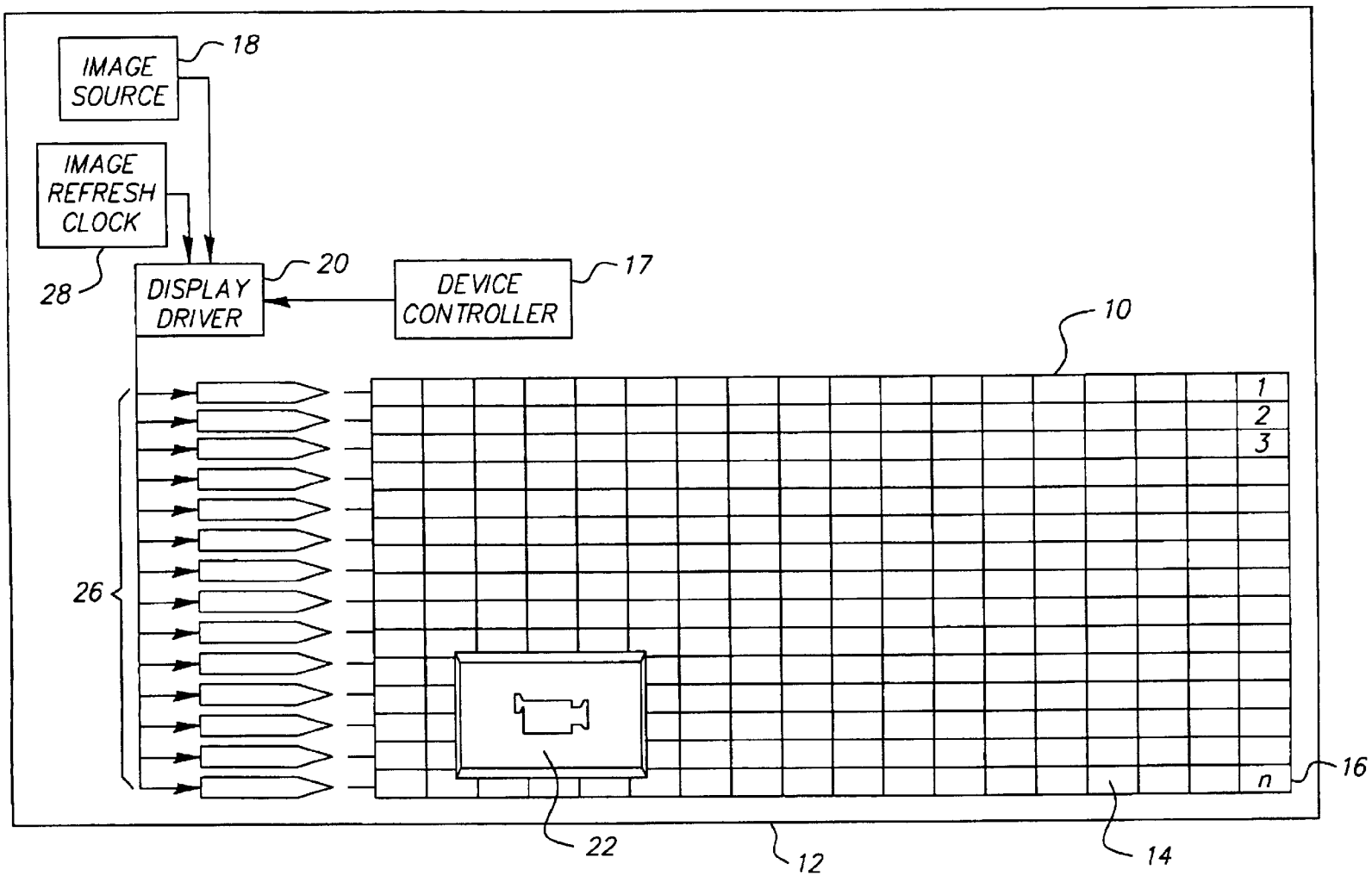
FIG. 1 (PRIOR ART)
FIG. 1 shows a video display system operating in accordance with the method of the prior art.

FIG. 1 shows an ELD 10 operated by a display driver 20 according to the method of the prior art. Display 10 is fixed in device 12. In this example, ELD 10 comprises an OLED having light emitting elements 14 that are organized into a vertical array of "n" horizontal rows 16. Each horizontal row 16 is associated with one of a plurality of row drivers 26. A device controller 17 controls display 10, an image source 18, and display driver 20. Image source 18 provides illumination values to the display driver 20. Image source 18 provides an image to display driver 20. Display driver 20 receives the image and transmits illumination values to row drivers 26 as shown in FIG. 1, or directly to elements 14. Where row drivers 26 are used, each row driver 26 received illumination values from display driver 20 and causes the elements 14 in the associated horizontal row 16 to illuminate at intensity levels that are characteristic of the illumination values. Image 22 appears on ELD 10 as a contrast pattern created by variations in the intensity of the light emitted by elements 14.

In the prior art, a method, known as the horizontal linear scanning method is used by display driver 20 to write illumination values. In this method, the illumination values are organized into "scan lines." Each scan line contains illumination values associated with those elements 14 that are located in a horizontal row 16. A sweep signal is used to write illumination values to elements 14. The sweep signal writes illumination values to elements 14 one scan line at a time.

It will be appreciated that, in the horizontal linear scanning method, illumination values are written to different elements 14 at different times. Thus, to form image 22 on ELD 10, it is necessary that elements 14 emit an intensity of light defined by the illumination values that are written to row drivers 26 for a period of time after the illumination values that are written. The length of time during which elements 14 will emit a defined intensity of light in response to the writing of an illumination value is known as the persistence period of elements 14.

The persistence period of elements 14 is finite. To maintain the appearance of image 22 the sweep signal repeatedly writes element illumination values to the display drivers 26 that operate elements 14 of ELD 10. This is known as refreshing the ELD 10. It will be appreciated that the rate at which ELD 10 must be refreshed is inversely proportional to the persistence period of elements 14.

It will also be appreciated that the rate at which the sweep signal must write illumination values can be determined from the refresh rate. This rate is known as the pixel rate. The pixel rate can be calculated by multiplying the refresh rate by the number of elements 14 in ELD 10. In the horizontal linear scanning method of the prior art, the number of elements 14 in ELD 10 is fixed and the persistence period of the elements 14 to be swept is also fixed. In the prior art, an image refresh clock 28 provides a clock signal having a period that is equal to the persistence period. The signal from image refresh clock 28 provides a timing signal to govern the writing of illumination values.

In one embodiment of the horizontal linear scanning method, a horizontal clock rate is also defined and is used to determine when the sweep signal is to transition from writing the illumination values associated with one scan line to writing the illumination values associated with another scan line. The horizontal clock rate is calculated by dividing the pixel clock rate by the number of elements in each horizontal row 16.

Figure 2:
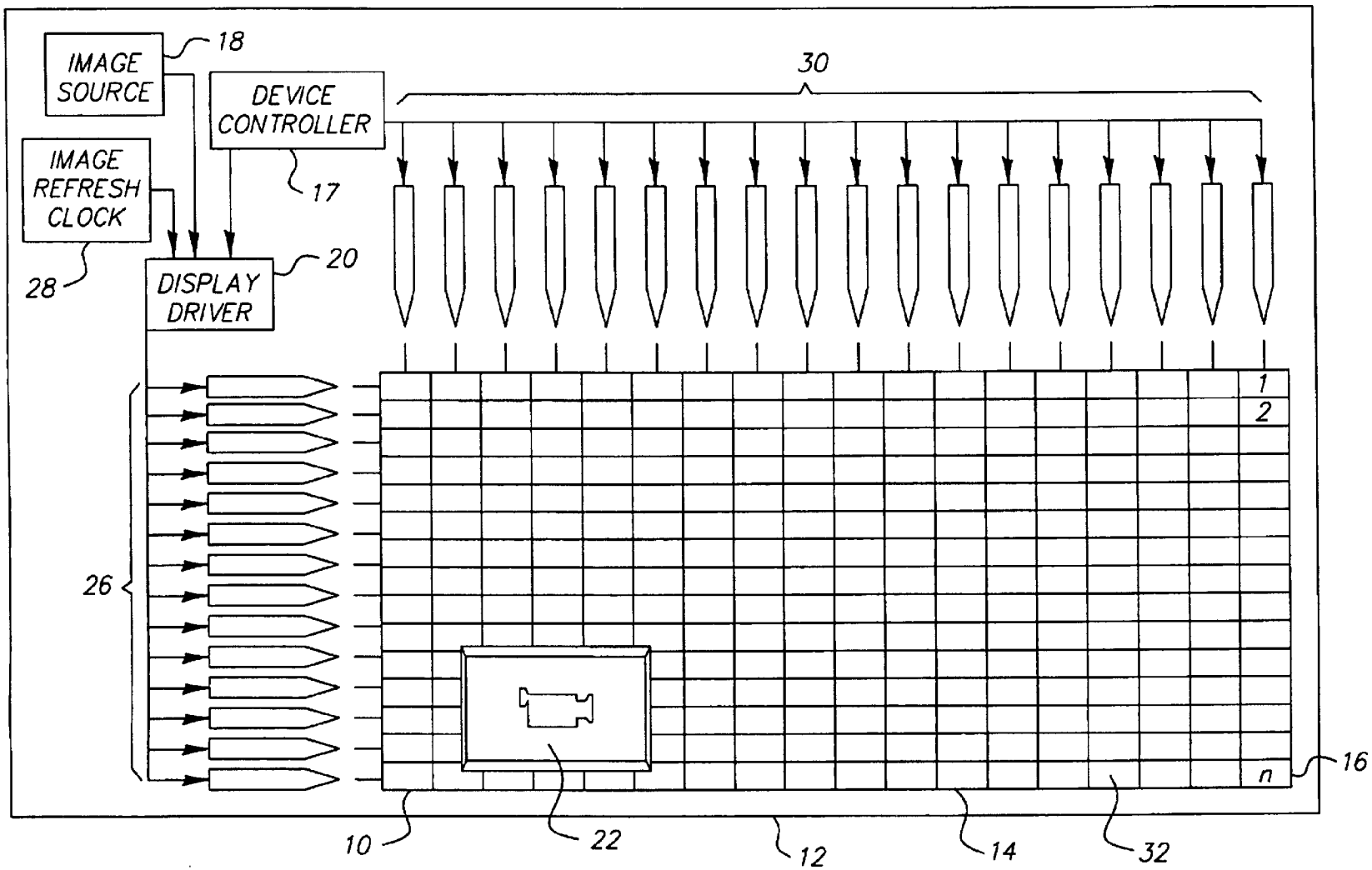
FIG. 2 (PRIOR ART)
FIG. 2 shows another embodiment of a video display system operating in accordance with the method of the prior art.

FIG. 2 shows an ELD 10 wherein illumination values are written to row drivers 26 and column drivers 30 in accordance with the horizontal linear scanning method of the prior art. As is shown in FIG. 2, elements 14 of ELD 10 are arranged into a matrix of rows 16 and columns 32. Each row 16 is operated by a row driver 26 and each column 34 is operated by a column driver 30. The illumination intensity of elements 14 is controlled by action of both row drivers 26 and column drivers 30. Here too, the method of choice for writing illumination values is typically the horizontal linear scanning method.

It will be recognized that it is not necessary to use every element 14 in ELD 10 to form image 22. However, the horizontal linear scanning method of the prior art still calls for sweeping illumination values into all of the elements 14 in ELD 10 regardless of the characteristics of the image. For example, if image 22 shown in FIGS. 1 and 2 requires the use of only 10% of elements 14 in ELD 10, the horizontal linear scanning method of the prior art still requires that illumination values are generated for all of elements 14 in ELD 10, the horizontal linear scanning method of the prior art still requires that illumination values are generated for all of elements 14 in ELD 10. Further, scan lines containing these illumination values for unused elements must be composed and swept. Each of these steps is unnecessary and expends energy.

Thus, the prior art does not meet the need for a more efficient display driver and method for presenting a partial image.

Figure 3:
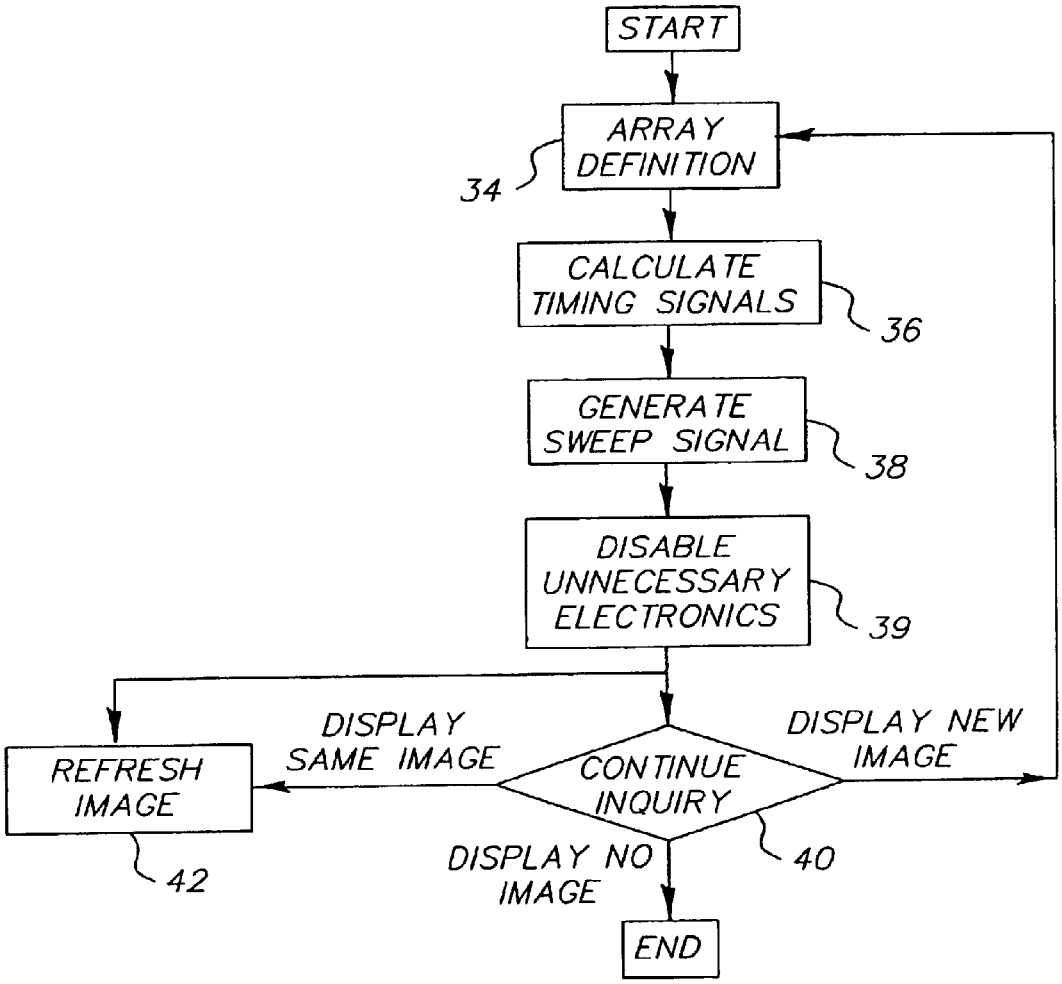
FIG. 3 shows a flow chart depicting one embodiment of the method of the present invention.
Figure 4A:
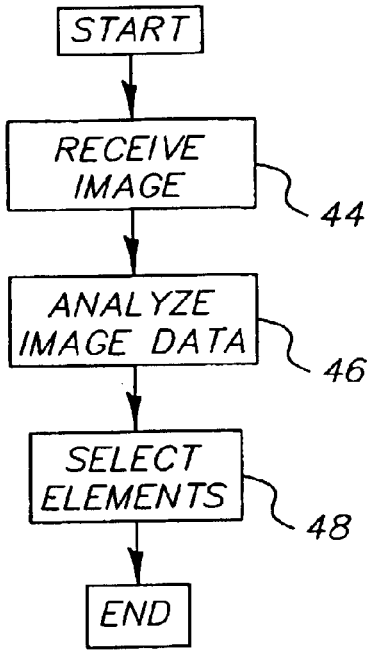
FIG. 4*a* shows a flow chart depicting one preferred embodiment of the method to define the elements to be included in an array.
Figure 4B:
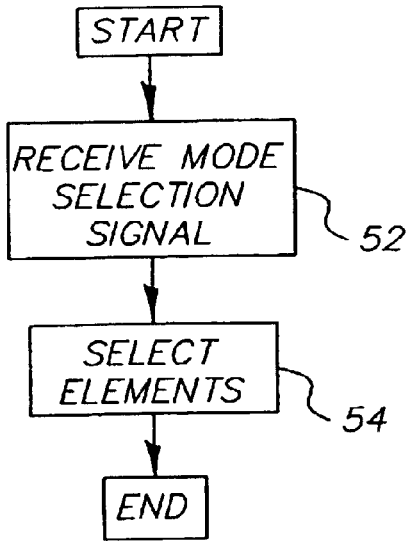
FIG. 4*b* shows a flow chart depicting another preferred embodiment of the method to define the elements to be included in an array.

FIGS. 3, 4*a* and 4*b* show flowcharts illustrating preferred embodiments of the present invention for displaying an image 22 using ELD 10, row drivers 16, device controller 17, display driver 20, image source 18 and column drivers 30.

As is shown in FIG. 3, the first step in the method of the present invention is the array definition step 34 wherein an array of elements 14 from ELD 10 is defined for use in displaying image 22. Those elements 14 that are not defined for use in the array are not used to display image 22. FIGS. 4*a* and 4*b*, respectively, show two preferred embodiments of step 34. In the embodiment of FIG. 4*a*, those elements 14 to be included in the array are defined by analysis of image 22. The first step in this embodiment is the Receive Image Step 44. In the Receive Image step 44, image 22 is transferred from image source 18 and received by display driver 20. Where necessary, Step 44 can include transforming the image received into illumination values. Image 22 is analyzed in the Analyze Image Data Step 46. This analysis can take many forms. For example, the analysis of image 22 can include an examination of the size and shape of image 22. Alternatively, image 22 can be examined to determine the number of elements 14 required to display image 22. In still another embodiment, image 22 is analyzed to determine the outline of image 22.

After the analysis of image 22 is complete, the method proceeds to a Select Array Elements step 48. In step 48, the analysis of the image 22 from step 46 is used to determine which of elements 14 are to be included in the array. Step 48 can be performed by selecting an array of elements 14 from a look-up table of predefined arrays based upon analysis of image 22. Step 48 can also be performed by selecting a pattern of elements 14 to include in the array based upon the analysis of image 22.

In the embodiment of FIG. 4*b*, the elements 14 to be included in the array are defined in response to a mode selection. The mode selection is made in the mode selection step 52. The mode selection can be made by the user of the portable electronic device 12. Alternatively, the mode selection can be made automatically by the device controller 17 or display controller 20. In step 54 the mode selection is used to select the elements 14 to be included in the array. Step 54 is preferably performed by using the mode selection to select an array of elements 14 from a look-up table that associates each mode of operation with a preferred array of elements 14 for the display of images in that mode.

It will be appreciated that other criteria can be used for selecting the elements to be included in the array. For example, in a further embodiment, (not shown) the selection of elements 14 to be included in the array is based on the content of image 22.

Returning now to FIG. 3, the next step in the method of the present invention is shown. This step is a Calculate Timing step 38 wherein the clock rate and the pixel rate are determined. As is discussed above, both the horizontal sweep rate and the pixel rate increase and decrease as a multiple of the number of elements 14 to which illumination values must be written. In the prior art, the number of elements 14 for which illumination values must be written is fixed. This is because in the horizontal linear scanning method of the prior art, the sweep signal writes illumination values to each of the elements 14 in ELD 10 during each sweep.

However, in the method of the present invention, the pixel rate and horizontal clock rate are not fixed. This is because the number of elements 14 for which illumination values must be written during each sweep is limited to include only those elements 14 that are in the array. Where the array includes fewer than all of elements 14 in ELD 10, a lower horizontal sweep rate and pixel rate can be used without degrading the appearance of image 22. Thus, in the present invention, a minimum pixel rate and minimum horizontal clock rate that must be used to maintain an image in an array can be determined by calculation. In particular, the minimum pixel rate can be determined by multiplying the number of elements 14 in the array by the persistence rate. The minimum horizontal clock rate can be calculated by multiplying the sweep rate by the number of elements 14 of a horizontal row 16. It will be appreciated that, consistent with the present invention, the pixel rate and horizontal clock rate can be operated at rates in excess of the minimum rates. However, operating at such increased rates reduced efficiency. It will be appreciated that the pixel rate and horizontal clock rate that are used in generating the sweep signal can be determined in other ways. For example, the pixel rate and horizontal clock rate for an array can be determined using a look-up table, that associates particular arrays with preferred pixel rates and horizontal clock rates.

Step 38 of FIG. 3 is the Sweep Signal Generation step, wherein a sweep signal is generated for writing illumination values. In the present invention, the sweep signal is defined to include only those illumination values associated with those elements 14 that are included in the array. No other illumination values are written by the sweep signal. The illumination values for those elements 14 in the array are incorporated into scan lines. The sweep signal transmits the scan lines to the row drivers 16 and column drivers 30 at the horizontal clock rate and the pixel rate.

The method of the present invention shown in FIGS. 3, 4*a* and 4*b* has been described as being used in conjunction with an ELD 10 having row drivers 26 and column drivers 32 to control the illumination status of elements 14. It will be appreciated that the array may not include any of elements 14 from certain of the rows 16 or columns 30. Thus, the method of FIG. 3 includes the optional step 39 of disabling those row drivers 26 and column drivers 30 that do not control the operation of any of the elements 14 in the array. It will also be appreciated that other discrete electronic components in display driver 20 such as a video memory (not shown) may not be necessary when the array incorporates less than all of elements 14 in ELD 10. Accordingly, optional steps of disabling these components can be performed to reduce the power consumed during operation of display 10.

Step 40 is the Continue Inquiry step. In step 40, it is determined whether it is necessary to continue refreshing the display of image 22 on ELD 10. Where a new image is to be displayed, the process returns to step 34. Where no image is to be displayed the process ends. If the same image 22 is to be displayed, then step 42, an Image Refresh step, repeats the sweep signal. It will be appreciated that by continually repeating the same sweep signal, it is not necessary to repeat the steps of receiving the image, determining the elements in the array or determining the pixel rate and/or horizontal clock rate. This conserves power.

The method of FIGS. 3, 4*a* and 4*b* has been shown and described in conjunction with a sweep signal that sweeps data into the display according to the horizontal linear scanning method. However, this has been done for the purpose of example only. It is not necessary to use the horizontal linear scanning method to practice the present invention in connection with a display of elements 14 operated by row drivers 26 and column drivers 30. This is because elements 14 can be individually addressed and therefore illumination values can be written to elements 14 in any order. Thus, any sweep signal that writes illumination values to elements 14 in the array can be used so long as illumination values are written to elements 14 in the array at least once during the persistence period. In such methods, the step of calculating a horizontal sweep rate can be omitted or modified as appropriate.

The method of FIGS. 3, 4*a* and 4*b* has also been shown and described in conjunction with row drivers 26 and column drivers 30. It will be appreciated however, that this method will also work in conjunction with an ELD 10 that uses only row drivers 26 to cause elements 14 to illuminate in response to the illumination values. An embodiment of the present method that uses only row drivers, the array is defined to include all of the elements 14 of each horizontal row 16 that will be used to display image 22 and illumination values and scan lines are generated only for those elements 14 of ELD 10 that are within the horizontal rows 16 of elements 14 associated with the array. The horizontal clock rate and pixel rate are then determined so that all of the scan lines and illumination values can be written within the persistence period. In such a method, a further power savings can be obtained by the further step of enabling only those horizontal row drivers that will be used in to operate elements within the array.

Figure 5:
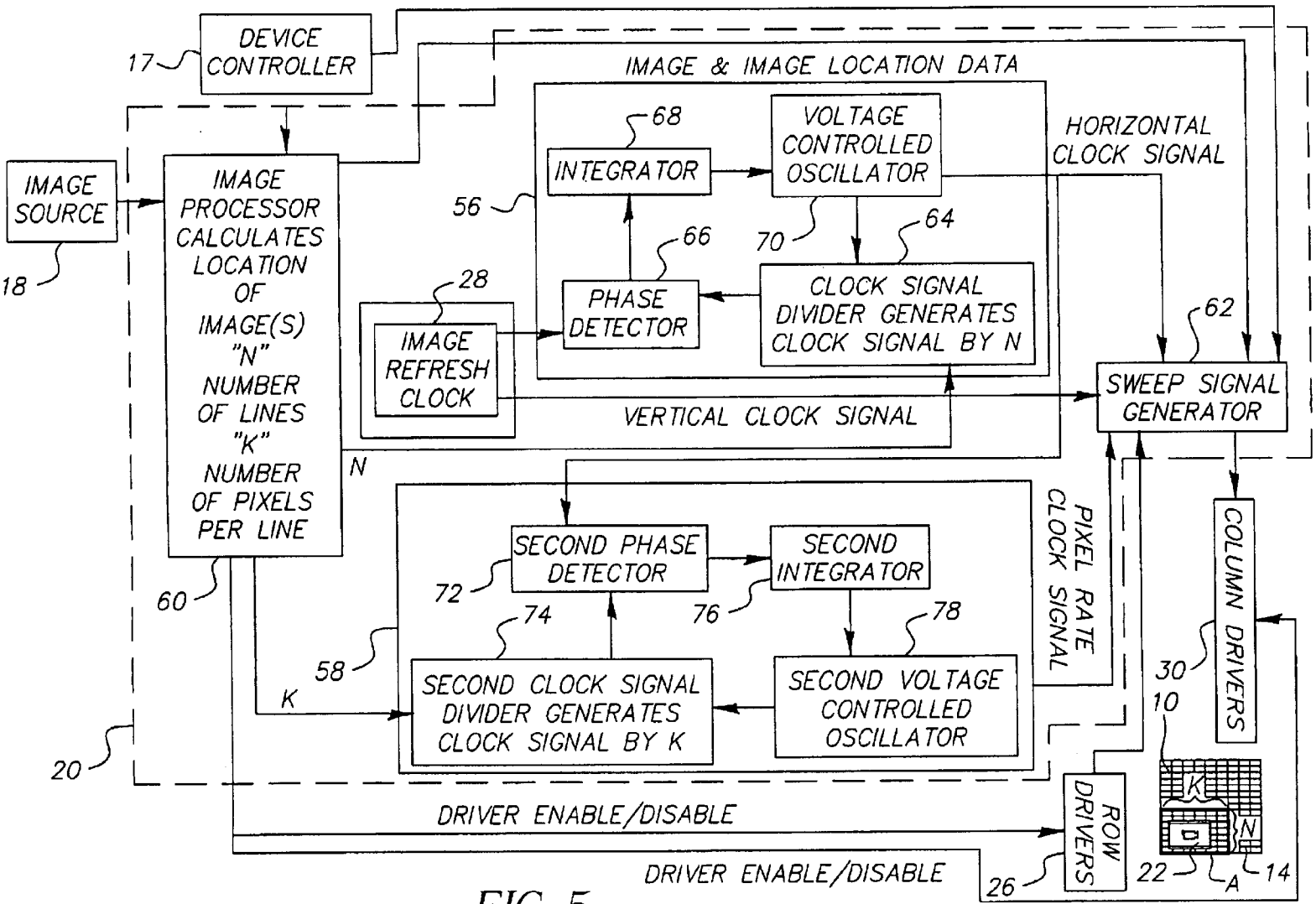
FIG. 5 shows a detailed embodiment of the display driver of he present invention.

FIG. 5 shows a detailed embodiment of the display driver 20 of the present invention. As is shown in FIG. 5, image source 18 delivers image 22 to an image processor 60. Image processor 60 analyzes image 22 and defines at least one array A of elements 14 for displaying image 22. In this embodiment of display driver 20, array A is defined as a function of a number "N" of horizontal rows 16 and a number "K" of columns 32 assigned to each horizontal row 16 in array A. Where necessary, image processor 60 also converts image 22 into illumination values.

As is shown in FIG. 5, a sweep signal generator 62 is used to generate a sweep signal to write illumination values to elements 14 within array A. Toward this end, sweep signal generator 62 receives illumination values and array information from image processor 60. Sweep signal generator 62 converts this information into a sweep signal that writes illumination values only to those elements 14 within array A. The sweep signal generator 62 generates "N" scan lines containing "K" pixel illumination values on each line. The sweep signal generator 62 combines the scan lines to form a sweep signal.

As is noted above, illumination values must be written for each of the elements 14 in the array A at a rate defined by the refresh rate and the number of elements 14 in the array A. In the embodiment of FIG. 5, the sweep signal generator 62 defines a sweep signal that writes illumination values for elements 14 within array A at a pixel rate that is defined by a pixel rate clock signal. The pixel rate clock signal is defined at a rate that is a function of a vertical clock signal and a horizontal clock signal.

In the embodiment shown in FIG. 5, image refresh clock 28 provides a vertical clock signal which runs at a rate that is at least equal to the refresh rate. The horizontal clock signal is calculated by multiplying the vertical clock signal by the number of lines "N" associated with array A. The number of lines "N" is calculated by the image processor 60 and transmitted to a horizontal clock signal generator 56. The horizontal clock signal generator 56 comprises a phase detector 66 which receives the vertical clock signal and the output of the clock divider circuit 64. The clock divider circuit 64 receives the output of the voltage controlled oscillator 70 which is driven by the phase detector 66 and integrator 68. Since the clock divider circuit 64 is set to divide the output of the voltage controlled oscillator 70 by "N" which it receives from the image processor 60, the effect is to multiply the vertical clock signal rate by "N" and it becomes the horizontal clock.

Because the vertical and horizontal sweep rates must be maintained in phase, horizontal clock signal generator 56 also comprises a phase locked loop arrangement using a phase detector 66, an integrator 68 and a voltage controlled oscillator 70. Phase detector 66 has, as its inputs, the vertical clock signal and the divided horizontal clock signal. The output from the phase detector 66 is fed into an integrator 68 and the resulting output of the integrator 68 drives a voltage controlled oscillator 70. The output from voltage controlled oscillator 70 is the horizontal clock signal.

The horizontal clock signal is used as an input for the sweep signal generator 62 and as an input into pixel rate clock signal generator 58 which is also a phase locked loop. The pixel rate clock signal generator comprises a second phase detector 72, a second clock signal divider 74, a second integrator 76 and a second voltage controlled oscillator 78. A second clock signal divider 74 receives the number of pixel illumination values "K" and divides the pixel rate clock signal by "K" which has the effect of multiplying the horizontal clock signal rate by "K". The second phase detector 72 has the inputs of the horizontal clock signal and an output from the second clock divider whose output is the voltage controlled oscillator 78 signal which has been divided by K. The second phase detector 72 drives the second integrator 76 whose output controls the voltage controlled oscillator 78. The output of second voltage controlled oscillator 78 is a pixel rate clock signal whose frequency is "K" times the horizontal clock signal. This signal is fed into the sweep signal generator 62.

Sweep signal generator 62 generates a sweep signal for writing illumination values for each of elements 14 in array A. Pixel illumination values are swept one scan line at a time into each of the "N" rows of array A. One scan line is written during every horizontal clock signal cycle. Consistent with this, the illumination values are written to the individual elements 14 of array A at the rate defined by the pixel rate clock signal. The sweep signal generated by the sweep signal generator 62 therefore conducts a full sweep of the elements 14 in array A at least once during every vertical clock signal.

It will be understood that image processor 60 may determine that certain of the row drivers 26 and/or column drivers 30 are unnecessary for display of an image using array A. Accordingly, image processor 60 is fixed to the row drivers 26 and column drivers 30 for disabling selected ones of row drivers 26 or selected ones of column drivers 30 for disabling selected ones of row drivers 26 or selected ones of column drivers 30 that are not required for the display of image 22.

Device controller 17 is shown in FIG. 5 connected to image processor 60. Device controller 17 is connected to image processor 60 to disable operation of the image processor 60, when the ELD 10 is not in use. An optional connection between device controller 17 and sweep signal generator 62 is shown. The purpose of this connection is to allow the device controller 17 to instruct sweep signal generator 62 to repeat the temporarily fixed sweep signal in a continuous fashion. In this regard, an optional sweep signal memory (not shown) within the sweep signal generator 62 can retain a sweep signal and permit the sweep signal to be repeated in a continuous fashion until display controller 17 instructs sweep signal generator 62 to cease the continual repetition. In this manner, where it is determined that a single image, such as a "power on" status indicator 72 is to be displayed on the ELD in a near-continuous fashion, image 22 can be maintained for extended periods without regenerating the sweep signal and recalculating array parameters such as "N" and "K" for the display of the indicator. It will be appreciated that this conserves power.

Figure 6:
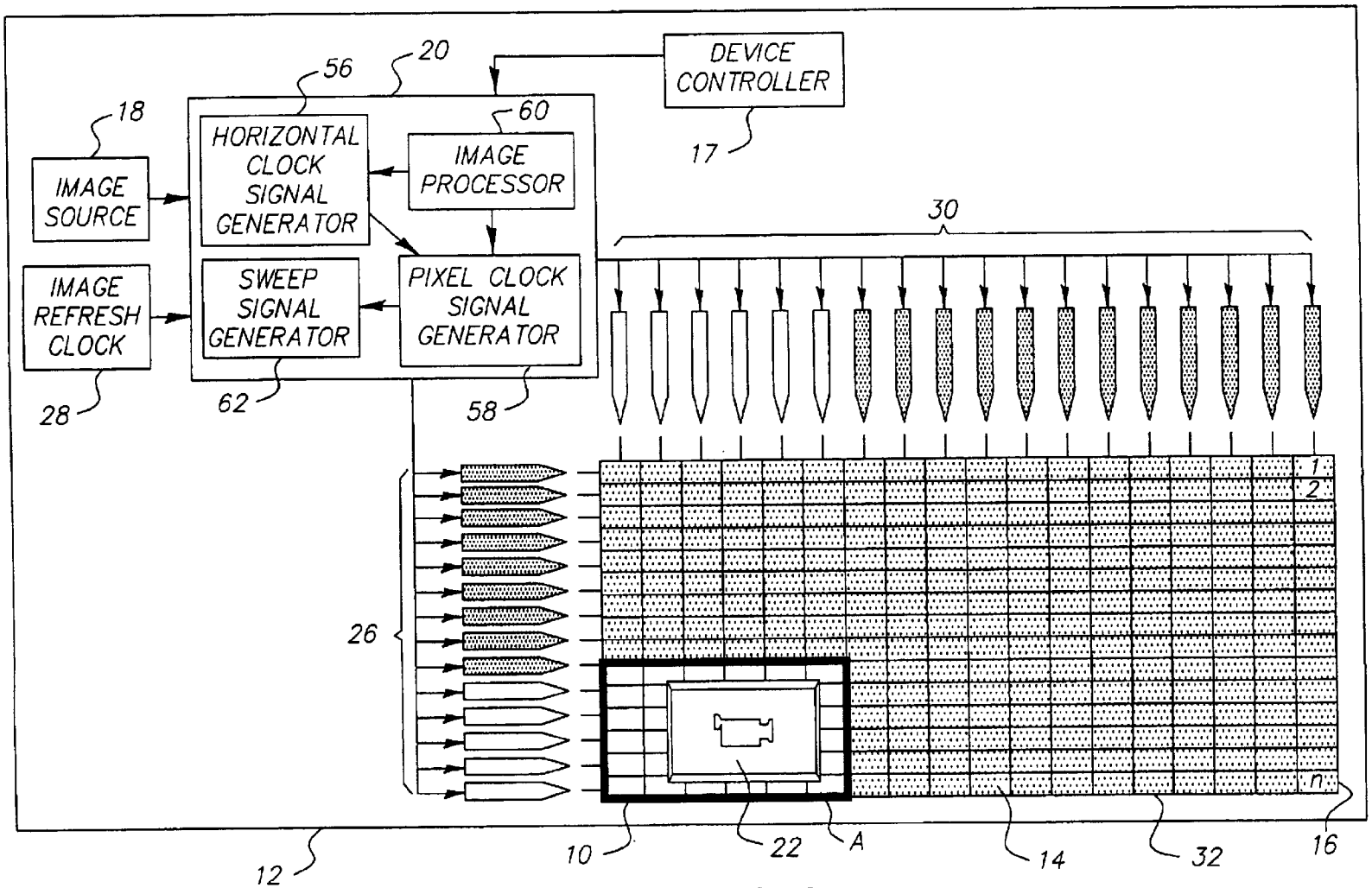
FIG. 6 shows a representation of the operation of an ELD having row drivers and column drivers operated by the display driver of the present invention to display a status indicator image.

FIG. 6 shows a similar representation of the operation of an ELD 10 operated by a display driver of the present invention to display a status indicator image 22. As is shown in FIG. 5, the array A of elements 14 used to display image 22 comprises only a portion of the elements 14 of ELD 10. Elements 14 that are not incorporated into array A are not used. Those elements 14 that are not used incorporated into array A are shown shaded in FIG. 6. It will be apparent then that the shaded row drivers 26 and column drivers 30 can be disabled during the presentation of image 22 as they do not operate any elements 14 within array A.

Figure 7:
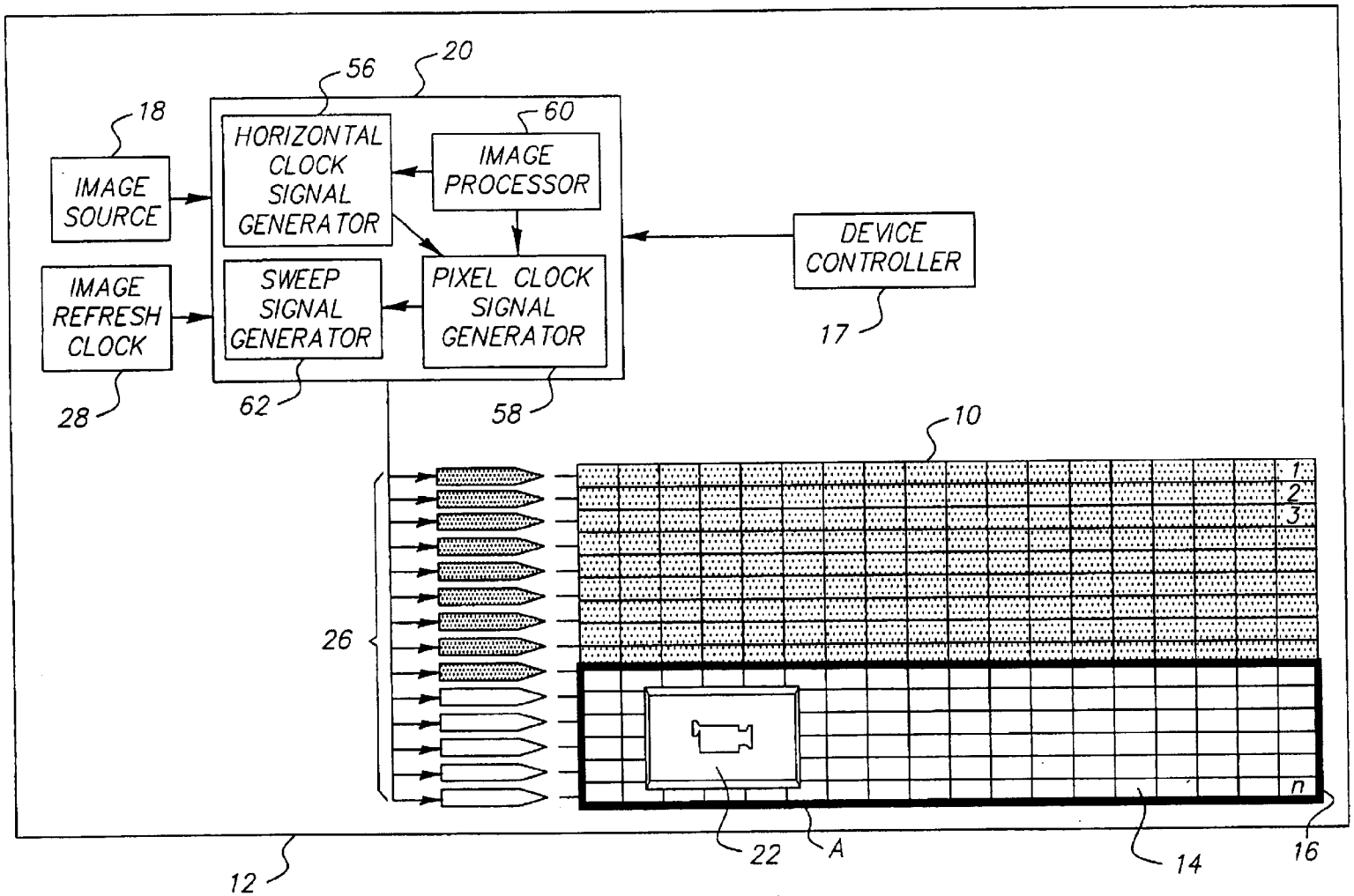
FIG. 7 shows representation of the operation of an ELD having only row drivers and operated by another embodiment of the display driver of the invention to display a status indicator image.

For example, FIG. 7 shows a representation of the operation of an ELD 10 having only row drivers 26 and operated by a display driver 20 of the present invention to display image 22. As is shown in FIG. 7, the array A of elements 14 used to display image 14 includes not only those elements 14 that are necessary to form image 22, but also all of the other elements 14 associated with any of the horizontal rows 16 which include elements 14 that are used to display image 22. Here too, the elements 14 that are not incorporated into array A are not used. Those elements 14 that are not used are shown shaded in FIG. 7. It will be apparent from FIG. 7 that those row drivers 26 that are shown shaded in FIG. 7 can be disabled during the presentation of image 22 as they do not operate any elements 14 within array A.

It will also be understood that the principles of the present invention can be used to define an array A with a variable number of "K" elements 14 in each horizontal row 16. Thus, for example, the first of "N" rows of array A can contain a first number of elements 14 while the second row can contain, for example, a second, lower number of elements 14. In such a circumstance the horizontal clock rate will be modified in accordance with the number of elements 14 in each horizontal row 16.

It will also be understood that display driver 20 can be used to display more than one image 22. In this embodiment, image processor 60 defines more than one array A to display the images. Alternatively, a single array A can be defined to display all of the more than one image 22. Where more than one image is displayed, further power savings can be accomplished by (what do we need here?) images to use common drivers and/or column drivers. This reduces the number of active row and column drivers.

The invention has been descried in detail with particular reference to certain preferred embodiments thereof, but it will be understood that variations and modifications can be effected within the spirit and scope of the invention.

| PARTS LIST |
|---|
| 10 Emissive Light Display |
| 12 Electronic Device |
| 14 Light Emitting Elements |
| 16 Horizontal Rows |
| 17 Device Controller |
| 18 Image Source |
| 20 Display Driver |

-continued

| PARTS LIST |
|---|
| 22 Image |
| 26 Row Drivers |
| 28 Image Refresh Clock |
| 30 Column Driver |
| 32 Column |
| 24 Array Definition Step |
| 36 Calculate Timing Step |
| 38 Generate Sweep Signal Step |
| 39 Disable Unnecessary Electronics Step |
| 40 Continue Inquiry |
| 42 Refresh Image Step |
| 44 Receive Image Step |
| 46 Analyze Image Step |
| 48 Select Elements Step |
| 52 Mode Selection Step |
| 54 Select Elements Step |
| 56 Horizontal Clock Signal Generator |
| 58 Pixel Clock Signal Generator |
| 60 Image Processor |
| 62 Sweep Signal Generator |
| 64 Clock Signal Divider |
| 66 Phase detector |
| 68 Integrator |
| 70 Voltage Controlled Oscillator |
| 72 Second Phase Detector |
| 74 Second Clock Signal Divider |
| 76 Second Integrator |
| 78 Second Voltage Controlled Oscillator |
| A Array |
| N Number of Horizontal Rows in array A |
| K Number of Columns in array A |
| N Number of Horizontal Rows |

What is claimed is:

1. A method for using a two-dimensional matrix of light emitting elements to display an image electronically encoded in the form of illumination values, the method comprising the steps of:

a) defining an array of elements including less than all of the elements in the matrix to display the image;

b) determining a pixel rate for writing the illumination values for the elements in the array;

c) assembling the illumination values for the elements of the array into horizontal scan lines and generating a sweep signal including each scan line; and d) generating a sweep signal incorporating each of the scan lines wherein the sweep signal writes illumination values for the elements in the array at the determined pixel rate and wherein the number of elements in each horizontal row of the array is not the same and further comprising the step of determining a horizontal sweep rate for each scan line, wherein the horizontal sweep rate for each scan line is at least equal to the pixel rate divided by the number of illumination values in each horizontal scan line.

2. The method of claim 1, wherein step a) comprises defining the elements in the array also based upon the shape of the image to be displayed by the array.

3. The method of claim 1, wherein step a) comprises defining the elements in the array of elements also based upon the size of the image to be displayed by the array.

4. The method of claim 1, wherein step a) comprises defining the elements in the array based upon image content.

5. The method of claim 1, wherein step a) further comprises the steps of selecting a display mode and defining the elements in the array from among a set of predefined arrays based on the display mode selection.

6. The method of claim 1, wherein step b) further comprises determining the pixel rate for the array to be at least equal to the predefined refresh rate of the elements multiplied by the number of elements in the array.

7. The method of claim 1, wherein step b) comprises determining the pixel rate by reference to a look-up table that matches the number of elements in the array to a pixel rate.

8. The method of claim 1, wherein the horizontal sweep rate for each row is at least equal to the pixel rate multiplied by the number of elements in that horizontal row of the array.

9. The method of claim 1, wherein the step of determining a pixel rate further comprises determining a sweep rate for each array, and the step of generating a sweep signal comprises generating more than one sweep signal, with each sweep signal writing illumination values for the elements in each array at a rate that is at least equal to the pixel rate for that array.

10. The method of claim 1, wherein the sweep signal is at least the number of elements in all of the arrays multiplied by the refresh rate of the elements, and the step of generating a sweep signal comprises generating a sweep signal that writes illumination values to the elements of all of the arrays.

11. A method for using a two-dimensional matrix of light emitting elements to display an image electronically encoded in the form of illumination values, the method comprising the steps of:

a) defining an array of elements including less than all of the elements in the matrix to display the image;

b) determining a pixel rate for writing the illumination values for the elements in the array; and c) generating a sweep signal having the illumination values for the elements in the array wherein the sweep signal writes illumination values for the elements in the array at the determined pixel rate;

wherein more than one image is to be displayed at the same time wherein one array of elements is defined to display each one of said images and wherein the elements in the array of elements are defined based upon the number of images to be displayed.

12. A method for using a matrix display of light emissive elements organized into a vertical array of horizontal rows to display an image encoded in the form of illumination values, the method comprising the steps of:

a) defining a set of horizontal rows having fewer than the total number of horizontal rows in the display for displaying the image;

b) determining a pixel rate for writing illumination values for the image to the elements in the defined set of horizontal rows;

c) generating a sweep signal that writes illumination values to the elements in each row in the set of horizontal rows; and d) writing a sweep signal having illumination values to the elements in the array at the determined pixel rate wherein the step of defining a set of horizontal rows for displaying the image comprises selecting a set of horizontal rows for displaying the image based upon the content of the image.

13. The method of claim 12, wherein the step of defining a set of horizontal rows for displaying the image further comprises defining a number of rows based upon the shape of the image.

14. The method of claim 12, wherein the step of defining a set of horizontal rows for displaying the image further comprises defining a number of rows based upon the size of the image.

15. The method of claim 12, wherein the step of defining a set of horizontal rows further comprises the steps of selecting a display mode based upon the content of the image and defining the elements in the array from among a set of predefined arrays based on a the display mode selection.

16. The method of claim 12, wherein the pixel rate is at least equal to the predefined refresh rate multiplied by the number of elements in the array.

17. The method of claim 16, wherein the horizontal clock rate is at least equal to the number of horizontal lines in the array multiplied by the refresh rate.

18. A display driver for using a two-dimensional matrix of light emitting elements to display more than one image encoded in the form of illumination values, the driver comprising:

a) an image source; and b) a controller receiving the image from the image source, said controller being adapted to (1) define an array of elements comprising fewer than all of the elements in the matrix for display of each image, (2) determine a pixel rate for writing illumination values to the arrays of elements, (3) generate images by writing illumination values to the elements in each array at the pixel rate determined for that array, c) separately enabled row drivers receiving the illumination values and operating the elements of the display in response to the illumination values;

wherein the controller defines at least one array of elements for displaying the images wherein said controller positions the arrays to reduce the number of row drivers that must be enabled to display the images in the arrays.

19. A display driver for using a two-dimensional matrix of light emitting elements to display more than one image encoded in the form of illumination values, the driver comprising:

a) an image source;

b) a controller receiving the images from the image source, said controller being adapted to (1) define an array of elements comprising fewer than all of the elements in the matrix for display of each image, (2) determine a pixel rate for writing illumination values to each array of elements, (3) generate images by writing illumination values to the elements in each array at the pixel rate, and c) separately enabled row drivers and column drivers receiving the illumination values and operating the elements of the display in response to the illumination values;

wherein the controller enables less than all of the drivers while also enabling at least those row and column drivers necessary to operate the elements in each array and wherein said controller positions the arrays to reduce the number of row and column drivers that are enabled to display the images.

* * * * *